US007903106B2

(12) United States Patent
Lan

(10) Patent No.: US 7,903,106 B2
(45) Date of Patent: Mar. 8, 2011

(54) DIGITAL-TO-ANALOG CONVERTER (DAC) FOR GAMMA CORRECTION

(75) Inventor: Ing-Jye Lan, Saratoga, CA (US)

(73) Assignee: Integrated Memory Logic, Inc., Campbell, CA (US)

( * ) Notice: Subject to any disclaimer, the term of this patent is extended or adjusted under 35 U.S.C. 154(b) by 1353 days.

(21) Appl. No.: 11/316,118

(22) Filed: Dec. 21, 2005

(65) Prior Publication Data

US 2007/0139328 A1 Jun. 21, 2007

(51) Int. Cl.
*G09G 5/00* (2006.01)

(52) U.S. Cl. ..... 345/211; 345/204; 345/205

(58) Field of Classification Search ..... 345/55, 345/76–78, 82, 89, 90, 96–100, 204, 205, 345/211, 690, 531, 536, 602–594; 700/2, 700/3, 19, 20; 315/169.3; 386/9; 341/144, 341/141, 143

See application file for complete search history.

(56) References Cited

U.S. PATENT DOCUMENTS

| | | | | |
|---|---|---|---|---|
| 4,921,334 | A * | 5/1990 | Akodes | 345/89 |
| 5,510,706 | A * | 4/1996 | Good | 324/166 |
| 5,572,211 | A * | 11/1996 | Erhart et al. | 341/144 |
| 6,618,628 | B1 * | 9/2003 | Davlin et al. | 700/3 |
| 6,876,365 | B1 * | 4/2005 | Tsutsui et al. | 345/536 |
| 6,914,547 | B1 * | 7/2005 | Swaroop et al. | 341/144 |
| 7,379,004 | B2 * | 5/2008 | Hsu et al. | 341/144 |
| 7,554,517 | B2 * | 6/2009 | Baum et al. | 345/89 |
| 2003/0043060 | A1 * | 3/2003 | Wei | 341/141 |
| 2004/0039456 | A1 * | 2/2004 | Davlin et al. | 700/3 |
| 2005/0128113 | A1 * | 6/2005 | Kyung-Myun | 341/138 |
| 2005/0168416 | A1 * | 8/2005 | Hashimoto et al. | 345/76 |
| 2006/0012696 | A1 * | 1/2006 | Zarnowski et al. | 348/294 |
| 2006/0202929 | A1 * | 9/2006 | Baum et al. | 345/89 |
| 2008/0177397 | A1 * | 7/2008 | Davlin et al. | 700/3 |

* cited by examiner

*Primary Examiner* — Prabodh M Dharia
(74) *Attorney, Agent, or Firm* — Sidley Austin LLP

(57) ABSTRACT

In one aspect, a system provides gamma correction in a thin-film-transistor (TFT) liquid-crystal-display (LCD). The system includes a digital-to-analog converter operable to receive digital control data. The digital-to-analog converter is operable to provide an output voltage for gamma correction in response to the digital control data.

41 Claims, 10 Drawing Sheets

12
VREFU_H
VREFU_H_OUT
Buffer
26
32
24
30
SDA
SCL
A0
r2C Interface
Register Banks for Gamma DACs
8-bit
8-bit
DAC
OUT1
OUT2
OUT3
OUT4
OUT5
OUT6
OUT7
VREFU_L
VREFU_L_OUT

DIGITAL-TO-ANALOG CONVERTER (DAC) FOR GAMMA CORRECTION

TECHNICAL FIELD OF THE INVENTION

This invention relates to integrated circuit (IC) devices, and more particularly, to a digital-to-analog converter (DAC) for gamma correction.

BACKGROUND

A thin-film-transistor (TFT) liquid-crystal-display (LCD) panel can be used in various applications, such as a notebook computer, a desktop monitor, or LCD television set. A TFT LCD panel has a matrix of pixels arranged in rows and columns. The columns of the matrix are driven by an analog voltage to create luminescence.

The relationship between the column drive (CD) analog voltage and the luminescence of a pixel is nonlinear (the so called "gamma curve") and during the manufacturing process, each panel may have slightly different gamma curve response. As the size of TFT LCD panels increases, this variance between CD analog voltage and pixel brightness becomes more of a concern.

To compensate for this well-known "gamma effect" phenomenon, and thus improve overall performance of a TFT LCD panel, a digital programmable gamma correction circuit is employed. The digital programmable gamma correction circuit provides a number of gamma corrected voltages (i.e. a proper fitted reference gamma curve) so the column drive (CD) can provide the "right" voltage to each pixel for the proper luminescence of pixels throughout the TFT LCD panel.

A digital programmable gamma correction circuit is typically implemented in an integrated circuit (IC) device. For a large panel TFT-LCD panel, a digital programmable gamma correction circuit may have digital programmable gamma buffers of fourteen (14) to twenty (20) channels. Each channel is separately programmable and accepts its own independent, programmable digital data from a standard Inter-IC ($I^2C$) interface or series port interface (SPI). Typically, an eight-bit (8-bit) to ten-bit (10 bit) digital-to-analog converter (DAC) is required for each of the digital programmable gamma channels to convert the independent, programmable digital data input into a corresponding analog voltage for use in adjusting luminescence. Because of the IC implementation of a programmable gamma correction circuit, it is desirable to optimize the layout for the circuit, for example, by reducing the size of the chip.

SUMMARY

According to an embodiment of the present invention, a system provides gamma correction in a thin-film-transistor (TFT) liquid-crystal-display (LCD). The system includes a resistor network comprising a plurality of resistors coupled in series between a first terminal and a second terminal. The resistor network is operable to provide a plurality of voltage values. A plurality of multiplexers are coupled to the resistor network. Each multiplexer is operable to receive and multiplex the plurality of voltage values from the resistor network to provide a first rail voltage and a second rail voltage. A digital-to-analog converter, coupled to the plurality of multiplexers, is operable to receive digital control data. The digital-to-analog converter is operable to provide an output voltage for gamma correction in response to the digital control data. The output voltage has a value between the first rail voltage and the second rail voltage.

According to another embodiment of the present invention, a multiplexer-based circuit is provided which is equivalent to an digital-to-analog converter with n bits of digital control. The circuit includes a first and second multiplexers operable to receive x of the n bits of digital control. The first and second multiplexers are operable to multiplex a plurality of voltage values in response to the x bits of digital control to provide a first rail voltage and a second rail voltage, respectively. A digital-to-analog converter, coupled to the first and second multiplexers, is operable to receive n-x of the n bits of digital control. The digital-to-analog converter is operable to provide an output voltage for gamma correction in response to the n-x bits of digital control data. The output voltage has a value between the first rail voltage and the second rail voltage.

According to yet another embodiment of the present invention, a digital-to-analog converter with n bits of digital control provides gamma correction in a thin-film-transistor (TFT) liquid-crystal-display (LCD). The converter includes n number of switches, each of the n switches being controlled by a respective bit of digital control. A first of the n switches is one size and each of the remaining n switches is an increasingly larger size relative to the first of the n switches.

According to still another embodiment of the present invention, a digital-to-analog converter with n bits of digital control provides gamma correction in a thin-film-transistor (TFT) liquid-crystal-display (LCD). The converter includes a dummy switch having a size and n number of additional switches. Each of the n additional switches is controlled by a respective bit of digital control. A first of the n additional switches is the same size as the dummy switch, and each of the remaining n additional switches is an increasingly larger size relative to the dummy switch.

According to still yet another embodiment of the present invention, a system with n bits of digital control provides gamma correction in a thin-film-transistor (TFT) liquid-crystal-display (LCD). The system includes a plurality of multiplexers operable to receive x of the n bits of digital control. The plurality of multiplexers are operable to multiplex a plurality of voltage values in response to the x bits of digital control to provide a first rail voltage and a second rail voltage. A digital-to-analog converter, coupled to the plurality of multiplexers, is operable to receive n-x of the n bits of digital control. The digital-to-analog converter is operable to provide an output voltage for gamma correction in response to the n-x bits of digital control data, wherein the output voltage has a value between the first rail voltage and the second rail voltage. The digital-to-analog converter comprises n-x number of switches. Each of the n-x switches is controlled by a respective bit of digital control. A first of the n-x switches is one size and each of the remaining n-x switches is an increasingly larger size relative to the first of the n-x switches.

Important technical advantages of the present invention are readily apparent to one skilled in the art from the following figures, descriptions, and claims.

BRIEF DESCRIPTION OF DRAWINGS

For a more complete understanding of the present invention and for further features and advantages, reference is now made to the following description taken in conjunction with the accompanying drawings.

DETAILED DESCRIPTION OF THE PREFERRED EMBODIMENTS

Embodiments of the present invention and their advantages are best understood by referring to FIGS. 1 through 7B of the drawings. Like numerals are used for like and corresponding parts of the various drawings.

Figure 1:
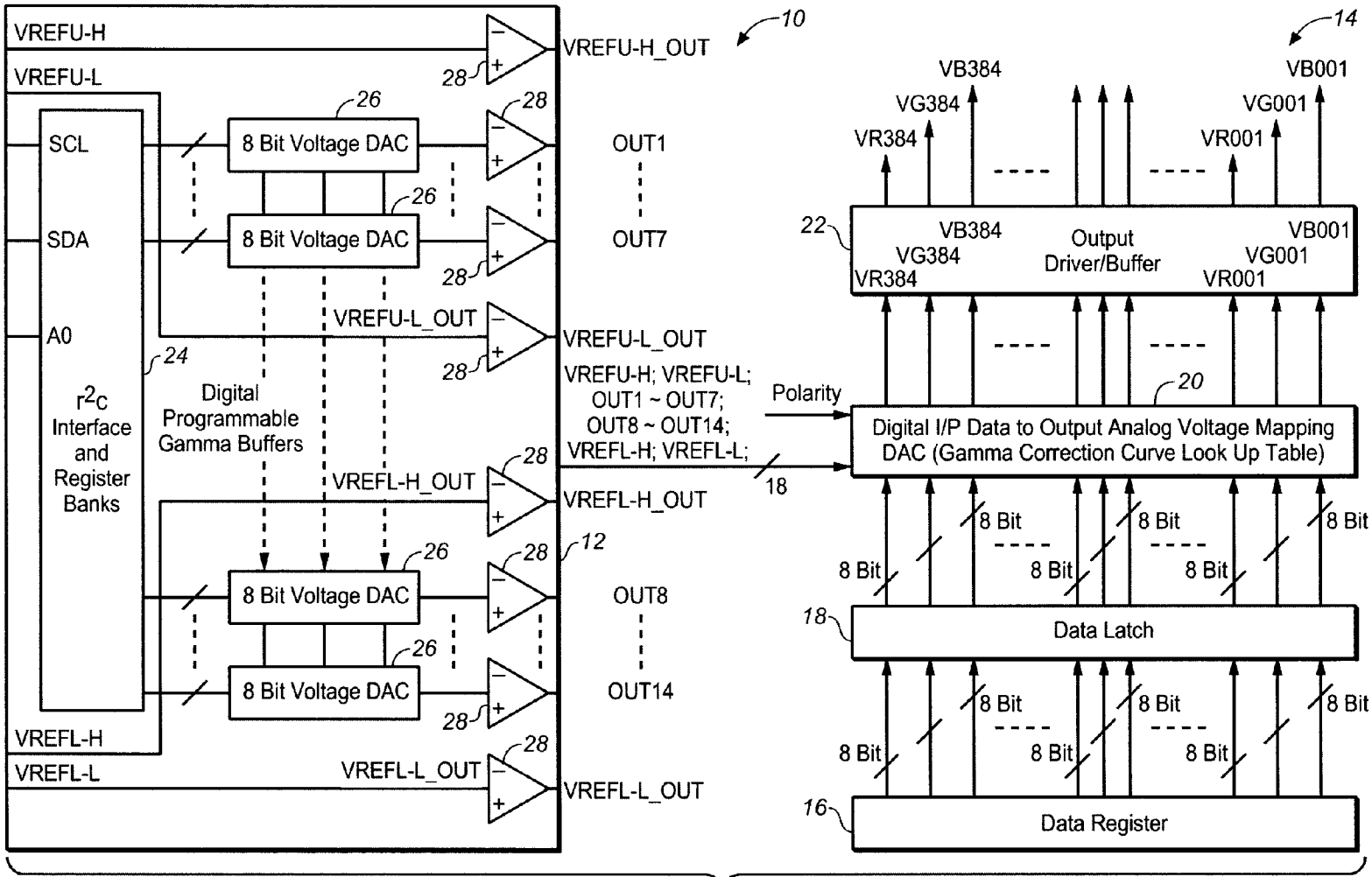
FIG. 1 is a block diagram of an exemplary architecture in which embodiments of the present invention may be incorporated and used.

FIG. 1 is a block diagram of an exemplary architecture 10 in which embodiments of the present invention may be incorporated and used. Architecture 10 includes a digital programmable gamma correction circuit 12 and a column driver circuit 14.

Column driver circuit 14 provides a number of voltages (e.g., VB001, VG001, VR001, . . . , VB384, VG384, and VR384) for driving the corresponding RGB (red, green, blue) pixels of a thin-film-transistor (TFT) liquid-crystal-display (LCD) panel. Separate voltages may be provided for red, green, blue (RGB) colors in each pixel of the TFT LCD in order to reproduce the proper colors on the display panel. Column driver circuit 14 receives voltage signals for a number of channels from digital programmable gamma correction circuit 12. As depicted, in one embodiment, there are four static channels of output (i.e., VREFU-H_OUT, VREFU-L_OUT, VREFL-H_OUT, VREFL-L_OUT) and fourteen channels of digital programmable gamma buffer output (i.e., OUT1 through OUT14). These static and digital programmable channel output voltages are used to "correct" the drive voltages supplied by column driver circuit 14 to the TFT LCD panel, thereby adjusting the luminescence of pixels throughout the panel to reproduce the proper color images on the TFT-LCD screen. As shown, column driver circuit 14 comprises a data register component 16, a data latch component 18, a lookup table component 20, and output driver/buffer component 22.

Digital programmable gamma correction circuit 12 is connected to and provides column driver circuit 14 with voltage signals for the static and digital programmable gamma buffer output channels. As used herein, the terms "connected," "coupled," or any variant thereof, means any connection or coupling, either direct or indirect, between two or more elements. Digital programmable gamma correction circuit 12 may receive a number of reference voltages (e.g., high reference voltage for upper channels (VREFU-H), low reference voltage for upper channels (VREFU-L), high reference voltage for lower channels (VREFL-H) and low reference voltage for lower channels (VREFL-L)) and other signals (SCL, SDA, A0) for Inter-IC ($I^2C$) interface. As shown, digital programmable gamma correction circuit 12 comprises an interface and registers component 24, multiple channel digital-to-analog converter (DAC) components 26, and multiple channel buffer components 28. In some embodiments, more than one digital programmable gamma correction circuit 12 can be provided or used in a system to support expansion of gamma correction capability.

Interface and register component 24 can function as an interface to receive, for example, series clock (SCL), series data (SDA), and one bit "address" ID (A0) signals for digital programmable gamma correction circuit 12. For this, component 24 can be implemented as any suitable interface, such as an Inter-IC ($I^2C$) interface or series port interface (SPI). Series data (SDA) signal may comprise or convey the series digital control information. Interface and register component 24 serves as a registers to store the digital control signals.

A separate set of n-bit digital control signals may be provided for each of m digital programmable gamma correction channels in circuit 12. In one embodiment, as shown, n=8 and m=14—i.e., there are eight (8) bits of control signals, and fourteen (14) channels of digital programmable gamma correction. But it is understood that in alternative embodiments, n can be any other suitable number of bits for digital control signals (e.g., ten), and m can be any other suitable number for digital programmable gamma correction channels (e.g., ten, twelve, sixteen, eighteen, twenty, etc.). In some embodiments, half of the m channels (e.g., channels 1 through 7) may be considered as upper channels, while the other half of the m channels (e.g., channels 8 through 14) may be considered as lower channels. In other embodiments, the channels are not separated into upper and lower channels.

In embodiments with upper and lower channels, the high and low reference voltages for upper channels (VREFU-H and VREFU-L) are the top and bottom "rails" for the upper channels of digital programmable gamma correction, and the high and low reference voltages for lower channels (VREFL-H and VREFL-L) are the top and bottom "rails" for the lower channels of digital programmable gamma correction. In embodiments where the channels are not separated into upper and lower channels, there is only one set of rails for high and lower reference voltages (VREF-H and VREF-L).

A separate DAC component 26 is provided for each channel of digital programmable gamma correction and receives the respective set of n-bit digital control signals from interface and register component 24. Each DAC component 26 functions to convert the respective n-bit digital control signals into a respective analog output signal for the associated channel. The analog output signals for the upper channels will have a value somewhere between VREFU-H and VREFU-L. The analog output signals for the lower channels will have a value somewhere between VREFL-H and VREFL-L. Buffer components 28 receive and buffer the reference voltages (e.g., VREFU-H, VREFU-L, VREFL-H, and VREFL-L) and the m analog output signals from the DAC components 26 to generate the static and digital programmable channel output voltage signals which are provided to column driver circuit 14 with enough sourcing and sinking capability (e.g., VREFU-H_OUT, VREFU-L_OUT, VREFL-H_OUT, and VREFL-L_OUT, OUT1 . . . OUT7, and OUT8 . . . OUT14).

As shown in FIG. 1, each of the DAC components 26 for the m digital programmable gamma correction channels will receive its own 8-bit digital programmable input through the interface and register component 24. The input-output transfer function for each DAC component 26 for the upper channels (DAC_i) is:

$$OUTi=(VREFU\text{-}L)+[(VREFU\text{-}H)-(VREFU\text{-}L)]/256*N_i$$

where i=1 to ½ m, and Ni is digital programmable independent 8-bit input data from the interface and register component 24 ($N_i$=0 to 255). Likewise, the input-output transfer function for each DAC component 26 for the lower channels (DAC_j) is:

$$OUTj=(VREFL\text{-}L)+[(VREFL\text{-}H)-(VREFL\text{-}L)]/256*N_j$$

where j=(½ m+1) to m, and Nj is digital programmable independent 8-bit input data (Nj=0 to 255).

The digital programmable gamma buffer output (with 4 static channels and 14 digital programmable channels) is sent to column driver circuit 14 to reproduce the proper color images on the TFT-LCD screen.

In a digital programmable gamma correction circuit 12, adjustments for the voltages of the gamma correction channels (e.g., OUT1 through OUT14) should be in one direction relative to increasing digital values (e.g., n) of the control bits. This "monotonic" characteristic is an important requirement during the manufacturing phase for an operator to optimize or finalize the "n" number for each of the DAC channels for optimal TFT LCD panel performance. Otherwise, an operator may be confused as what is the best "n" number during final manufacturing calibration.

Figures 2, 2A, 2B:
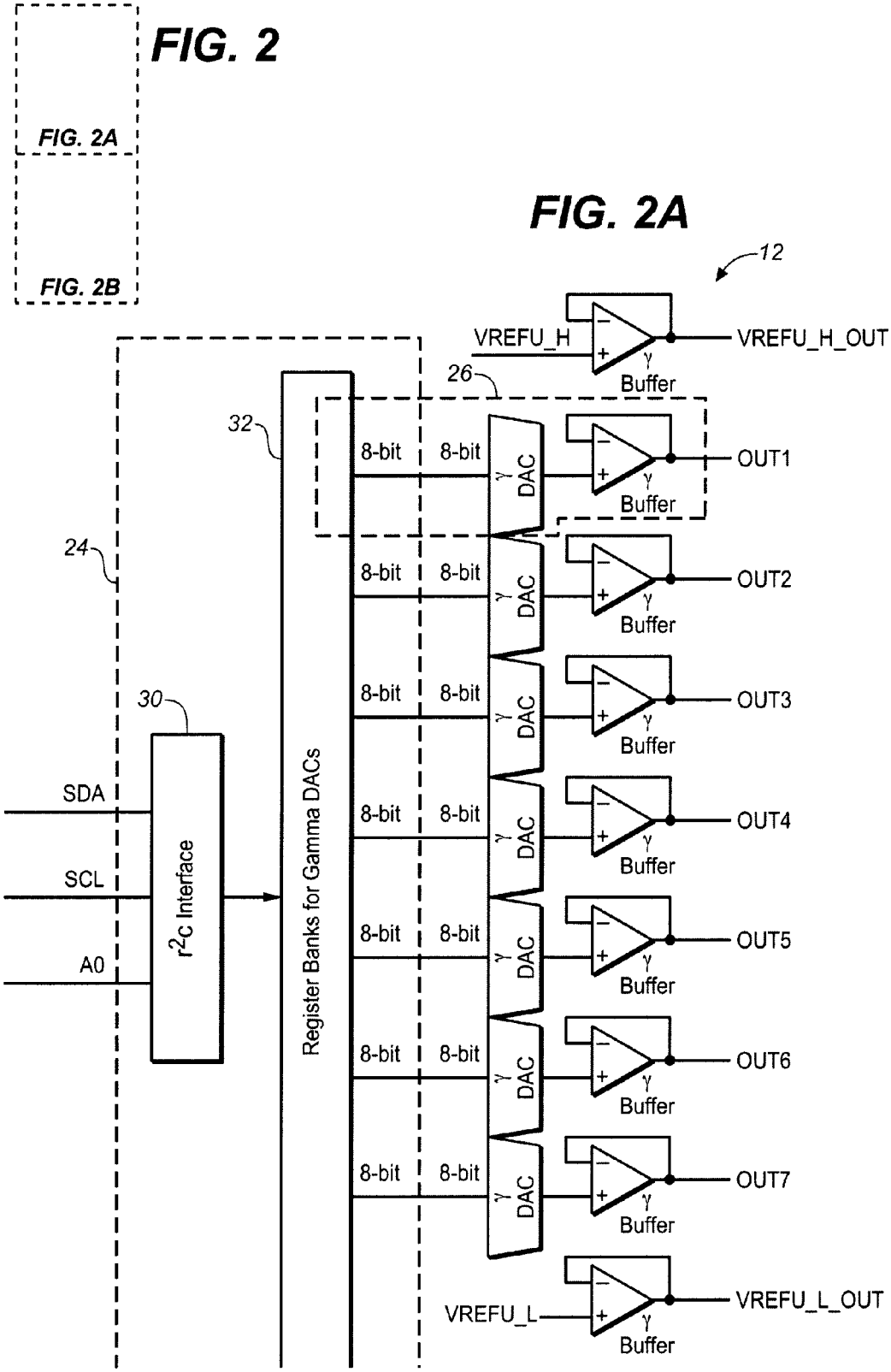
FIG. 2 is a schematic diagram, in partial block form, of an exemplary implementation for a digital programmable gamma correction circuit in which embodiments of the present invention may be incorporated and used.
Figure 2B:
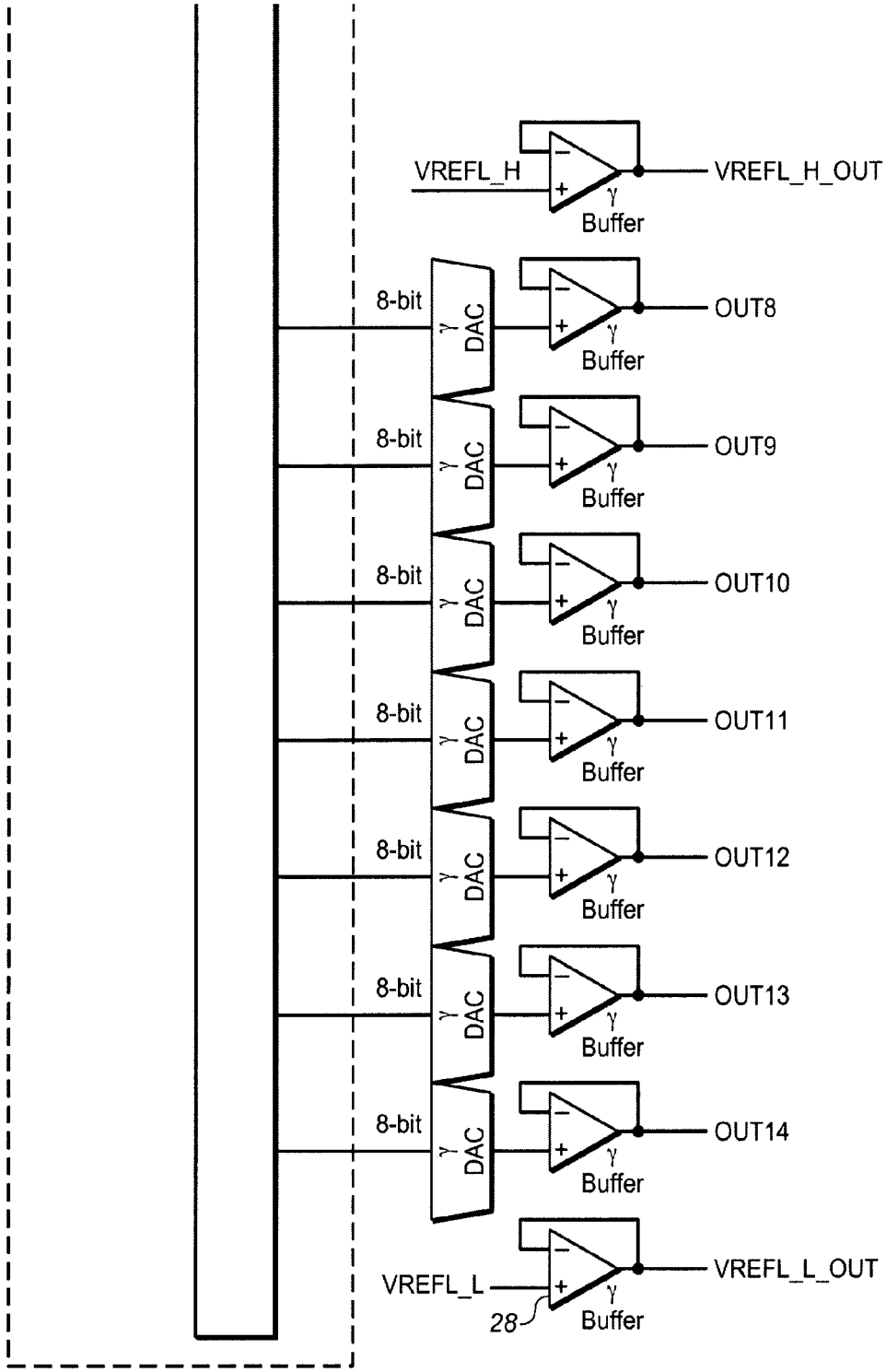

FIG. 2 is a schematic diagram, in partial block form, of an exemplary implementation for a digital programmable gamma correction circuit 12 in which embodiments of the present invention may be incorporated and used. Digital programmable gamma correction circuit 12 provides m channels of gamma correction, using n-bits of digital control signals for each of the m channels. In one embodiment, n=8 and m=14. As shown, in one embodiment, digital programmable gamma correction circuit 12 includes interface and register component 24, m number of DAC components 26 (one for each of the m channels, where m=14), and a plurality of buffer components 28. Interface and register component 24 includes an $I^2C$ interface component 30 and a register bank component 32.

In one embodiment, each of digital programmable gamma correction circuit 12 and column driver circuit 14 can be implemented on a separate semiconductor die (commonly referred to as a "chip"). In another embodiment, digital programmable gamma correction circuit 12 and column driver circuit 14 can be implemented on the same semiconductor die. A die is a monolithic structure formed from, for example, silicon, germanium, or other suitable semiconductor material. Digital programmable gamma correction circuit 12 and column driver circuit 14 can be packaged together or separately in suitable packaging, such as, for example, as a standard ball grid array (BGA) or thin quad flatpack (TQFP). However, other types of packaging may be used. For example, the packaging may have a ceramic base with wire bonding or employing thin film substrates, and mounting on a silicon substrate or a printed circuit board (PCB) substrate. The packaging may further utilize various surface mount technologies such as a single in-line package (SIP), dual in-line package (DIP), zig-zag in-line package (ZIP), plastic leaded chip carrier (PLCC), small outline package (SOP), thin SOP (TSOP), flatpack, and quad flatpack (QFP), to name but a few, and utilizing various leads (e.g., J-lead, gull-wing lead) or BGA type connectors. Digital programmable gamma correction circuit 12 and column driver circuit 14 may be connected through one or more bond pads, bonding wires, traces, etc. to provide communication between the circuits and/or other components within or external thereto.

Figure 3:
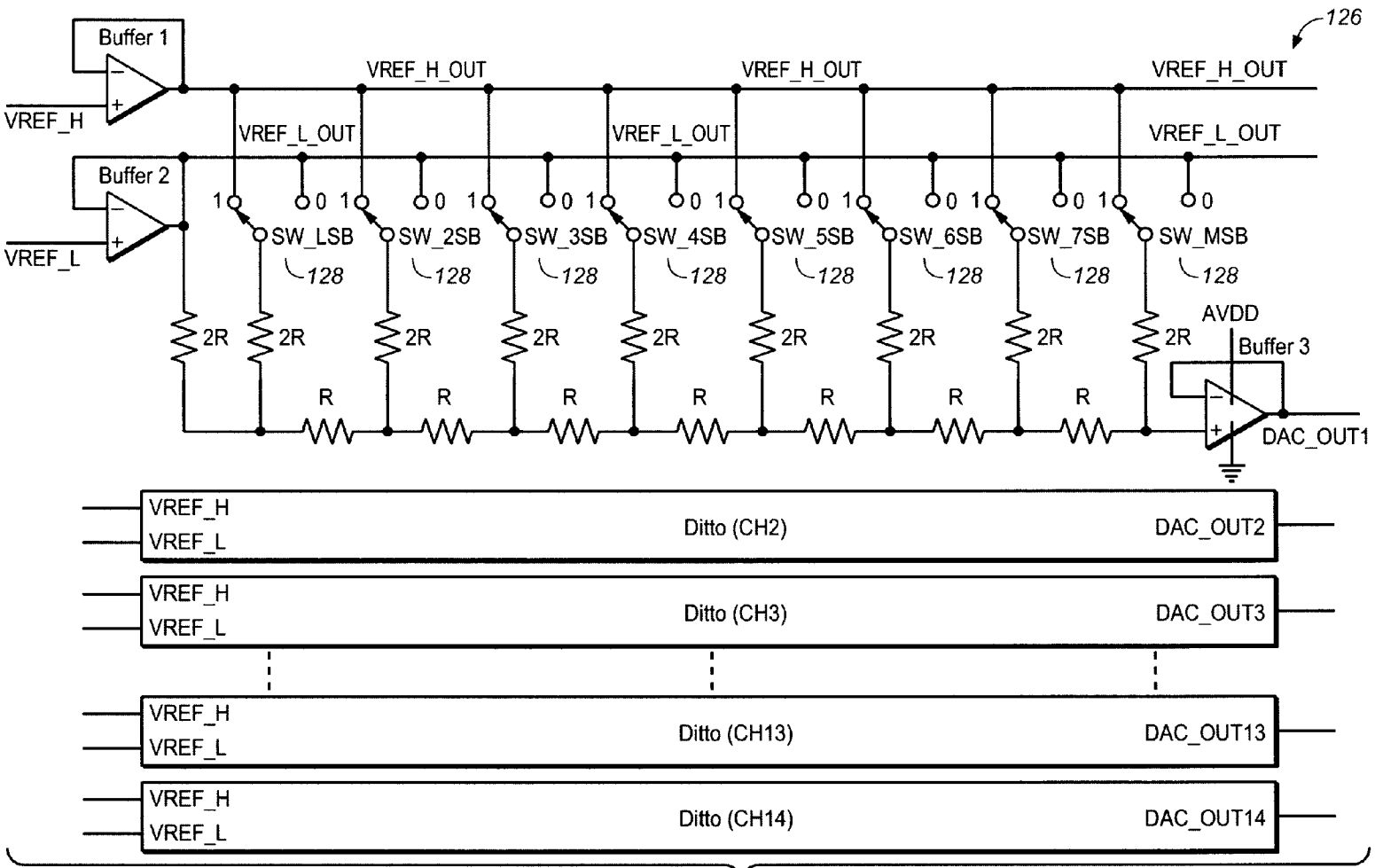
FIG. 3 is a schematic diagram of a multiple channels of digital-to-analog converter (DAC) circuit implementation.
Figure 4:
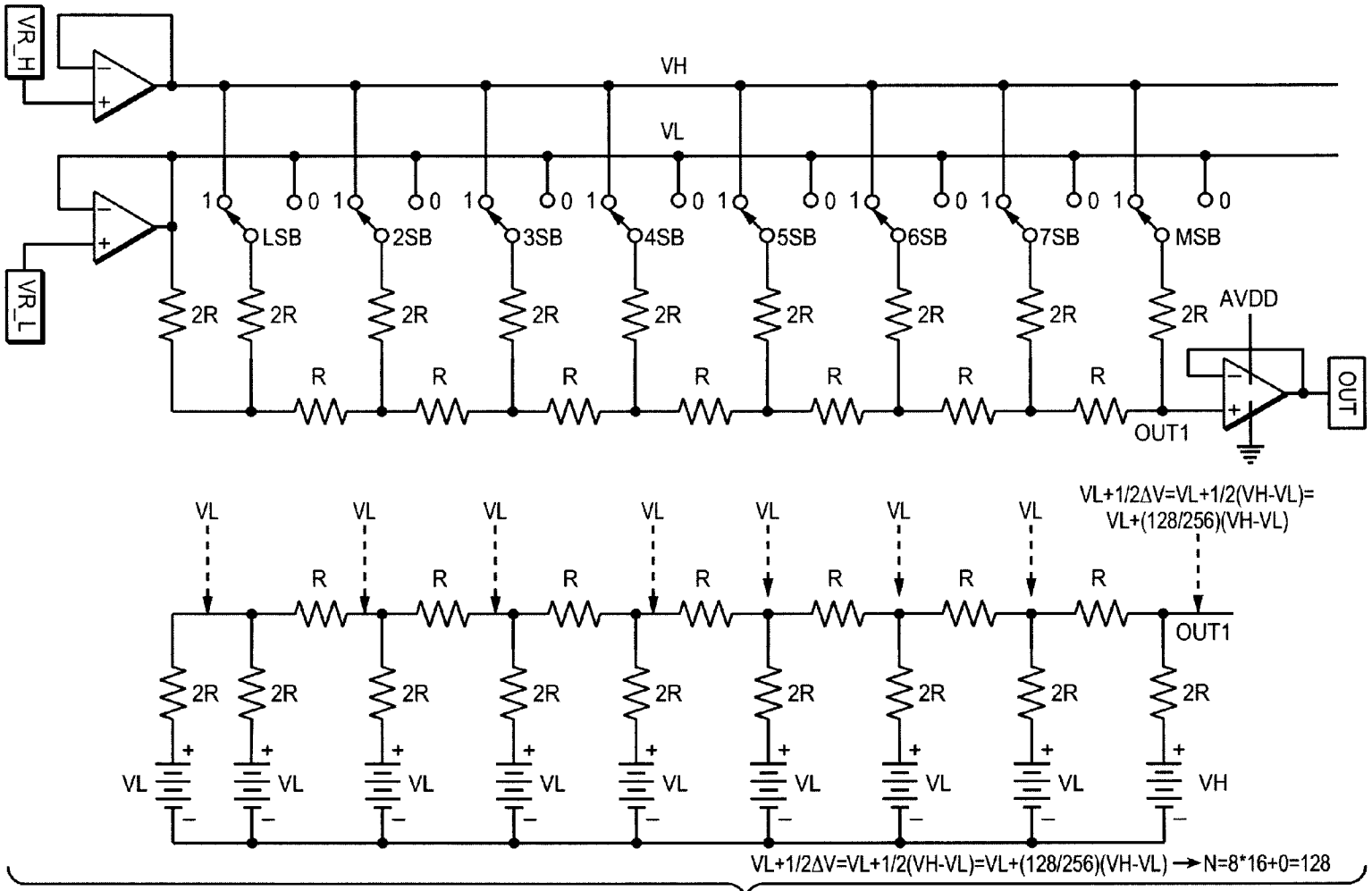
FIG. 4 is an equivalent circuit diagram for the DAC circuit shown in FIG. 3

FIG. 3 is a schematic diagram of a multiple channel digital-to-analog converters (DACs) circuit 126, which is a typical implementation for DAC component 26 of a digital programmable gamma correction circuit 12 (shown in FIGS. 1 and 2). FIG. 4 shows one channel of DAC and its equivalent circuit diagram (e.g. when n=80h or n=10000000 in binary) for the DAC circuit 126 shown in FIG. 3.

The DAC circuit 126 receives n-bit control signals (with n=8 in this case). The n bits of control range from least significant bit (LSB) to most significant bit (MSB). In such typical implementation, n number of switches 128 are used—$SW_{LSB}$, $SW_{2SB}$, $SW_{3SB}$, $SW_{4SB}$, $SW_{5SB}$, $SW_{6SB}$, $SW_{7SB}$, and $SW_{MSB}$. Each switch 128 is separately controlled by one of the n bits of control. The switches 128 are implemented with PMOS and/or NMOS devices, and are the same size.

In order to enhance the performance of the DAC circuit 126, it is necessary to minimize the effect of the switch-on resistance (Rdson) of switches 128. This is accomplished by making the width/length (W/L) ratio of the switches 128 as large as possible, thereby minimizing the absolute Rdson. However, a very large total layout area is needed for such an implementation. Thus, assuming that the width/length (W/L) ratio of each switch 128 is 50 units, then the implementation for the typical DAC circuit 126 is approximately 400 units.

Embodiments of the present invention may optimize the digital programmable gamma correction circuit 12. For example, in one embodiment, the present invention reduces the layout size of a programmable gamma correction circuit on a chip while maintaining the required "monotonic" characteristics of the digital programmable gamma correction circuit.

According to some embodiments of the present invention, a multiplexer-based implementation for a DAC component 26 is provided.

Figure 5:
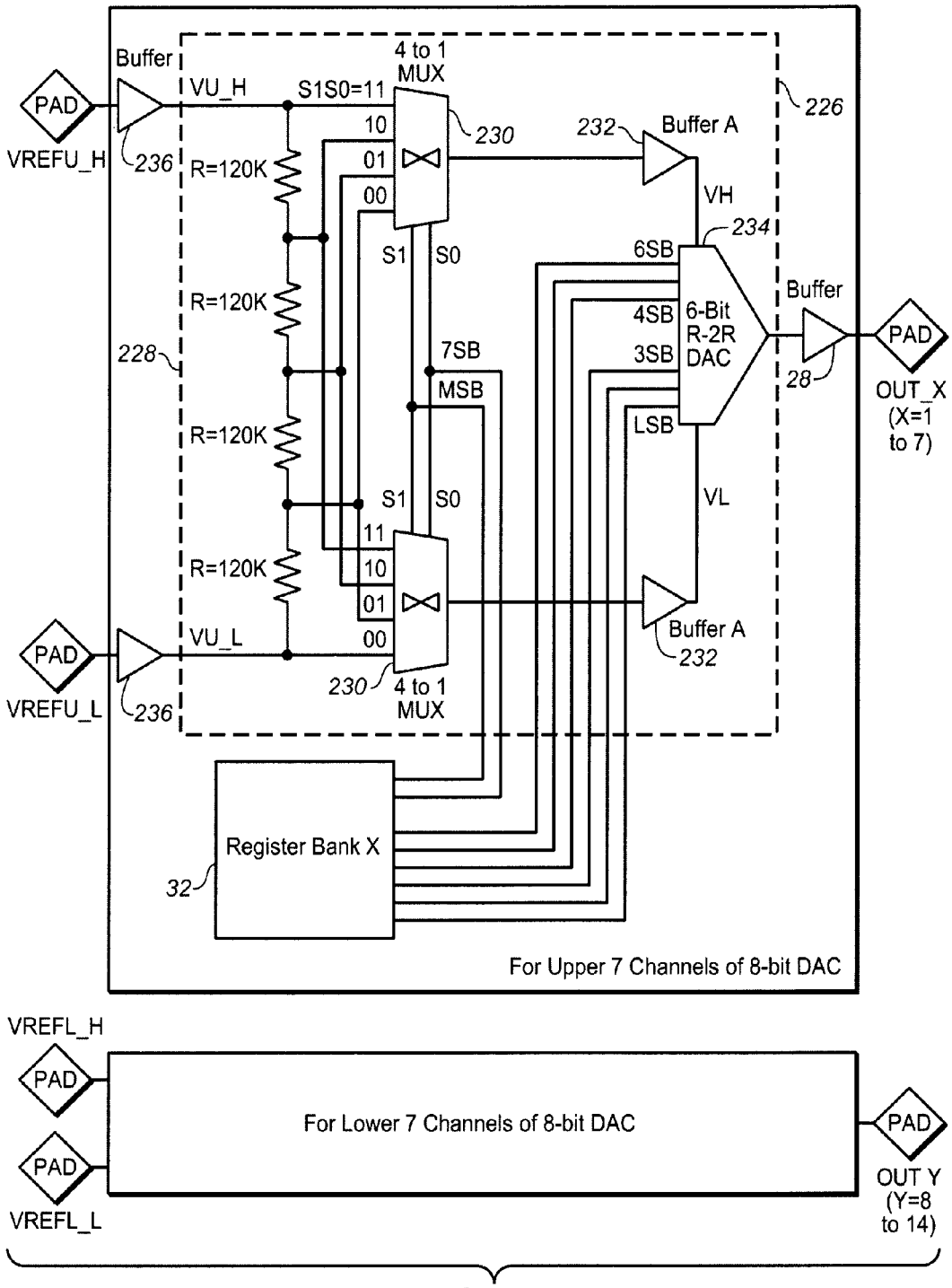
FIG. 5 is a schematic diagram, in partial block form, for an exemplary implementation of a multiplexer-based equivalent circuit for a DAC, according to an embodiment of the invention.

FIG. 5 is a schematic diagram, in partial block form, for an exemplary implementation of such a multiplexer-based equivalent DAC component 226, according to an embodiment of the invention. Multiplexer-based equivalent DAC component 226 can be used for each DAC component 26 in digital programmable gamma correction circuit 12 shown in FIGS. 1 and 2.

In one embodiment, for a digital programmable gamma correction circuit 12 with m channels of correction, m number of multiplexer-based equivalent DAC components 226 are provided. Of these, the multiplexer-based equivalent DAC components 226 for the upper ½ m channels receive the high and low reference voltages for upper channels (VREFU-H and VREFU-L). The multiplexer-based equivalent DAC components 226 for the lower ½ m channels receive the high and low reference voltages for lower channels (VREFL-H and VREFL-L). For simplicity, the remainder of this description will primarily describe details of a multiplexer-based equivalent DAC component 226 for the upper ½ m channels of digital programmable gamma correction, but it should be understood that details of a multiplexer-based equivalent DAC component 226 for the lower ½ m channels will be similar.

As depicted in FIG. 5, in one embodiment, the multiplexer-based equivalent DAC component 226 comprises an input resistor divider network 228, two multiplexers 230, two unit gain buffers 232, and a DAC circuit 234. Buffers 236 receive and buffer the high and low reference voltages for the upper channels (VREFU-H and VREFU-L) to provide upper rail voltage (VU_H) and lower rail voltage (VU_L), respectively, for multiplexer-based equivalent DAC component 226. Resistor divider network 228, which is connected between upper and lower rail voltages VU_H and VU_L, divides the voltages to create a plurality of voltage values. These voltage values are provided as the inputs to each of the multiplexers 230.

In this embodiment, the multiplexers 230 are each 4-to-1 multiplexers, but it should be understood that in other embodiments, multiplexers 230 can be 8-to-1, 16-to-1 or any other suitable multiplexer configuration. Each multiplexer 230 receives from register bank 32 control signals (S1 and S0), which correspond to the more significant bits of digital control (e.g., MSB and 7SB). For each multiplexer 230, one of the input voltage values is selected to be the output based on the control signals. An exemplary implementation of multiplexer circuit 230, according to an embodiment of the invention, is shown in and described with reference to FIG. 6.

A respective unit gain buffer 232 receives and buffers the output of each multiplexer 230 to provide a voltage high (VH) and a voltage low (VL) for DAC circuit 234. Each unit gain buffer 232 can be implemented with a very high input impedance buffer. DAC circuit 234 receives from register bank 32 control signals which correspond to the lower bits of digital control (e.g., LSB, 2SB, 3SB, 4SB, 5SB, and 6SB). In this example, DAC circuit 234 has 6 bits of control. DAC circuit 234 converts the digital control information into an analog voltage signal having a value between VH and VL. The analog output voltage signal of DAC 234 is received by a buffer 28 of digital programmable gamma correction circuit 12. The buffered signal is provided as one of the digital programmable channel output voltage signals (e.g., OUT1 through OUT14) to column driver circuit 14.

In general, to achieve the equivalent of a digital-to-analog converter with n-bits of control, multiplexer-based equivalent DAC component 226 can be implemented using $2^x$-to-1 multiplexers for multiplexers 230 and a n-x-bit DAC circuit 234. Thus, as shown in FIG. 5, for 8 bits of digital control (i.e., n=8), for example, equivalent DAC component 226 may comprise 4-to-1 multiplexers (where x=2, and $2^x$=4) and a 6-bit DAC circuit 234 (where n−x=8−2=6). Alternatively, equivalent DAC component 226 could comprise 8-to-1 multiplexers (where x=3, and $2^x$=8) and a 5-bit of DAC circuit 234 (where n−x=8−3=5). In yet another alternative, equivalent DAC component 226 may comprise 16-to-1 multiplexers (where x=4, and $2^x$=16) and a 4-bit DAC circuit 234 (where n−x=8−4=4).

Figure 6:
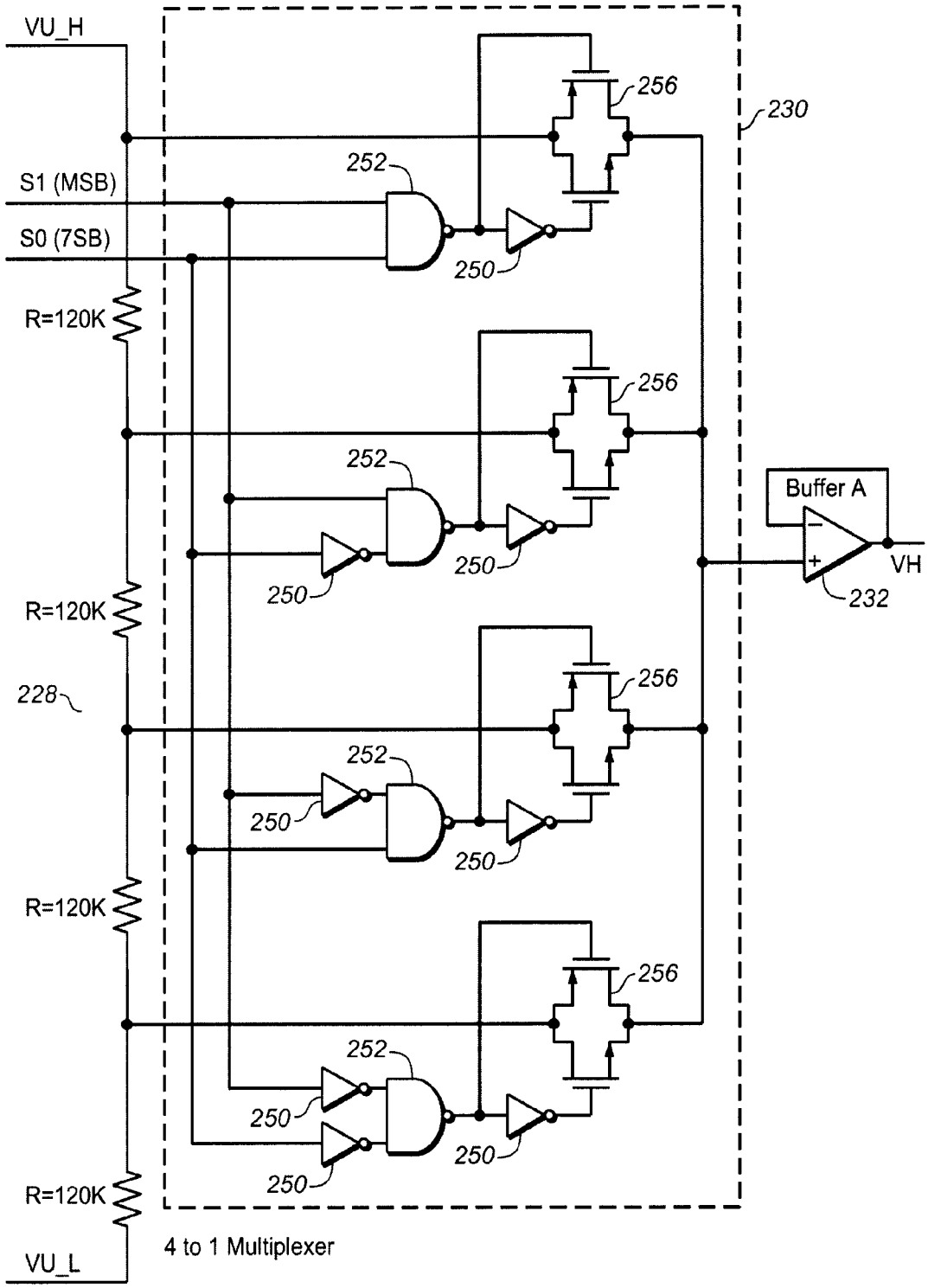
FIG. 6 is schematic diagram, in partial block form, for an exemplary implementation of a multiplexer circuit, according to an embodiment of the invention.

FIG. 6 is schematic diagram, in partial block form, for an exemplary implementation of a multiplexer circuit 230, according to an embodiment of the invention. Multiplexer circuit 230 may be used in a multiplexer-based equivalent circuit for a DAC (such as multiplexer-based equivalent DAC component 226) in a digital programmable gamma correction circuit 12. The multiplexer circuit 230 can be connected between a resistor divider network 228 and a unit gain buffer 232. In this embodiment, multiplexer circuit 230 is implemented as a 4-to-1 multiplexer, although it should be understood that in other embodiments, a 8-to-1, a 16-to-1 or any other suitable multiplexer implementation can be used.

As depicted, multiplexer circuit 230 comprises a plurality of inverter gates 250, NAND gates 252, and transmission gates 256. Transmission gates 256 are connected at different points to the resistor divider network 228, which develops a number of voltage values. Each transmission gate 256 will pass or transmit a respective one of the voltage values out of the multiplexer circuit 230 in response to a different set of values for S1 and S0 control signals, which correspond to the more significant bits of digital control (e.g., MSB and 7SB). Transmission gates 256 can each be implemented with two switches or transistors. Since the output of multiplexer circuit 230 is connected to a very high input impedance buffer 232, the size of the switches for the transmission gates 256 can be relatively small. The inverter gates 250 and NAND gates 252 implement the logic for applying the S1 and S0 control signals to the transmission gates 256.

Multiplexer-based equivalent DAC component 226, implemented as shown in FIGS. 5 and 6, performs the same function as the typical DAC circuit 126. That is, multiplexer-based equivalent DAC component 226 achieves the same resolution of control as DAC circuit 126 (e.g., 8-bit resolution).

However, multiplexer-based equivalent DAC component 226 can be implemented in a smaller layout area than the typical DAC circuit 126. In particular, relative to the DAC circuit 126, fewer switches are used to implement the DAC circuit 234 since the DAC circuit 234 has fewer bits of control—e.g., 8 bits of control for the DAC circuit 126 versus 4, 5, or 6 bits of control for DAC circuit 234. Furthermore, the resistor divider network 228, multiplexers 230, and unit gain buffers 232 of the multiplexer-based equivalent DAC component 226 can be implemented in a relatively small amount of layout space, which is significantly less than that which is required for the extra switches contained in the typical DAC circuit 126. In various alternatives for the 8-bit equivalent, multiplexer-based equivalent DAC component 226, any increase in layout size from using 16-to-1 multiplexers instead of 4-to-1 multiplexers is compensated with a decrease in layout size by using a 4-bit DAC circuit 234 instead of the 6-bit DAC circuit 234.

Furthermore, multiplexer-based equivalent DAC component 226 may achieve better monotonic characteristics than a typical DAC circuit 126. This is because multiplexer-based DAC component 226 requires at least one less bit of DAC control to achieve the same resolution as a conventional DAC implementation—i.e., component 226 requires only (n-x)-bit DAC instead of n-bit DAC. With less bits of DAC control, the layout mismatching (which is one of the major causes of non-monotonic characteristics in DAC design) is significantly reduced.

As such, the multiplexer-based equivalent DAC component 226 provides numerous technical advantages, especially in a multiple channel (e.g., m=12, 14, 18, 20 . . . ) digital programmable gamma correction circuit 12 since the total DAC layout size will repeated for m (e.g., m=12, 14, 18, 20 . . . ) times.

According to some embodiments of the present invention, the layout size of a DAC component 26 in a digital programmable gamma correction circuit 12 can also be reduced using an implementation for a digital-to-analog converter (DAC) with progressively increasing switch sizes. In particular, with embodiments of the invention, it is recognized that the ratio of switch-on resistance (Rdson) between adjacent switches in a DAC circuit is more critical than the absolute Rdson of all of the switches. So instead of minimizing the absolute on-resistance value of the switches in the DAC circuit (by making all of the switches larger), embodiments of the present invention maintain certain ratios between the size of adjacent switches in the DAC implementation. When the ratio of switch sizes are maintained, the effect of the absolute DAC switch on-resistance is automatically nulled out and the overall size of all switches is less important. Accordingly, the sizes for a number of switches on the DAC circuit can be reduced significantly.

Figures 1, 2, 7A:
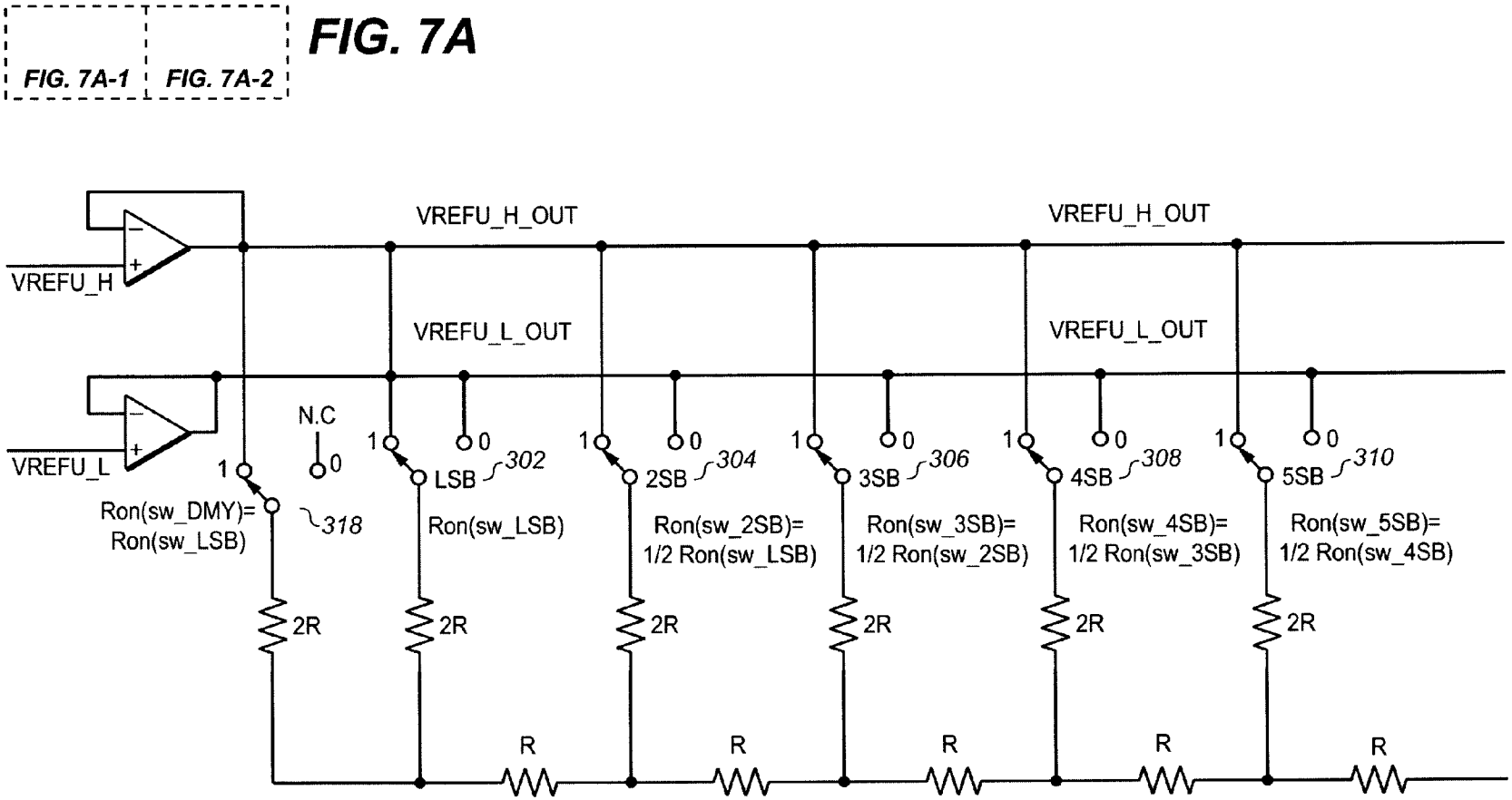
FIGS. 7A and 7B are schematic diagrams for exemplary implementations of DAC circuits with progressively increasing switch sizes, according to embodiments of the invention.
Figures 2, 7A:
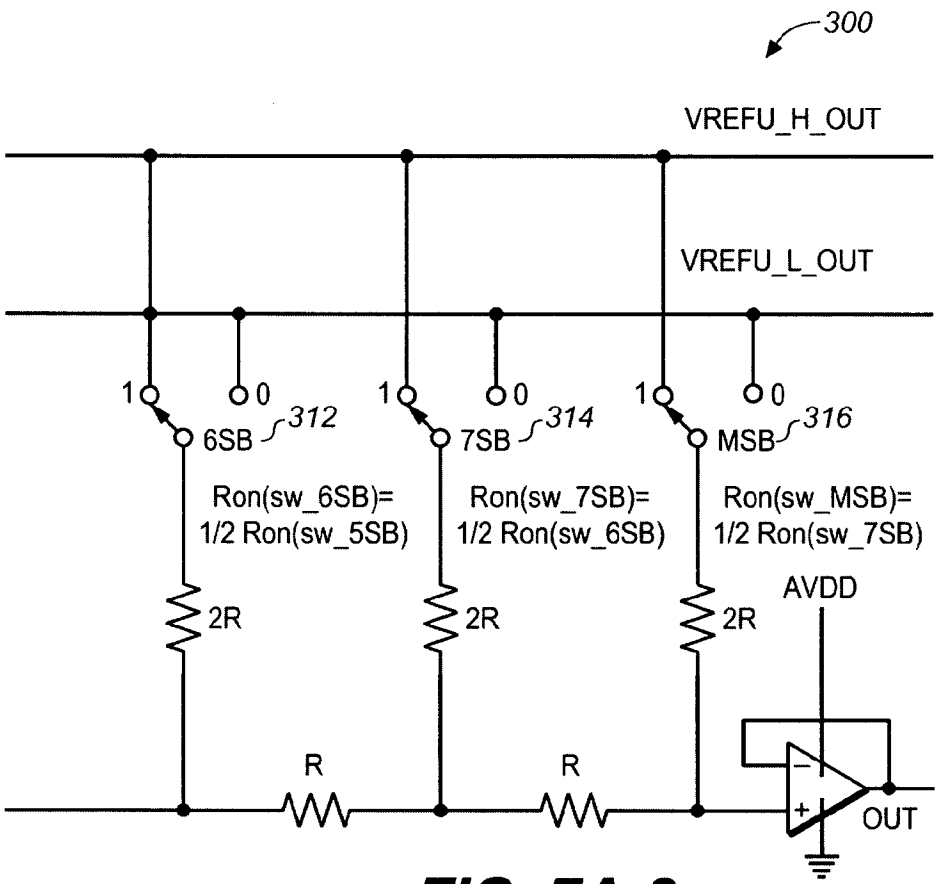
Figure 7B:
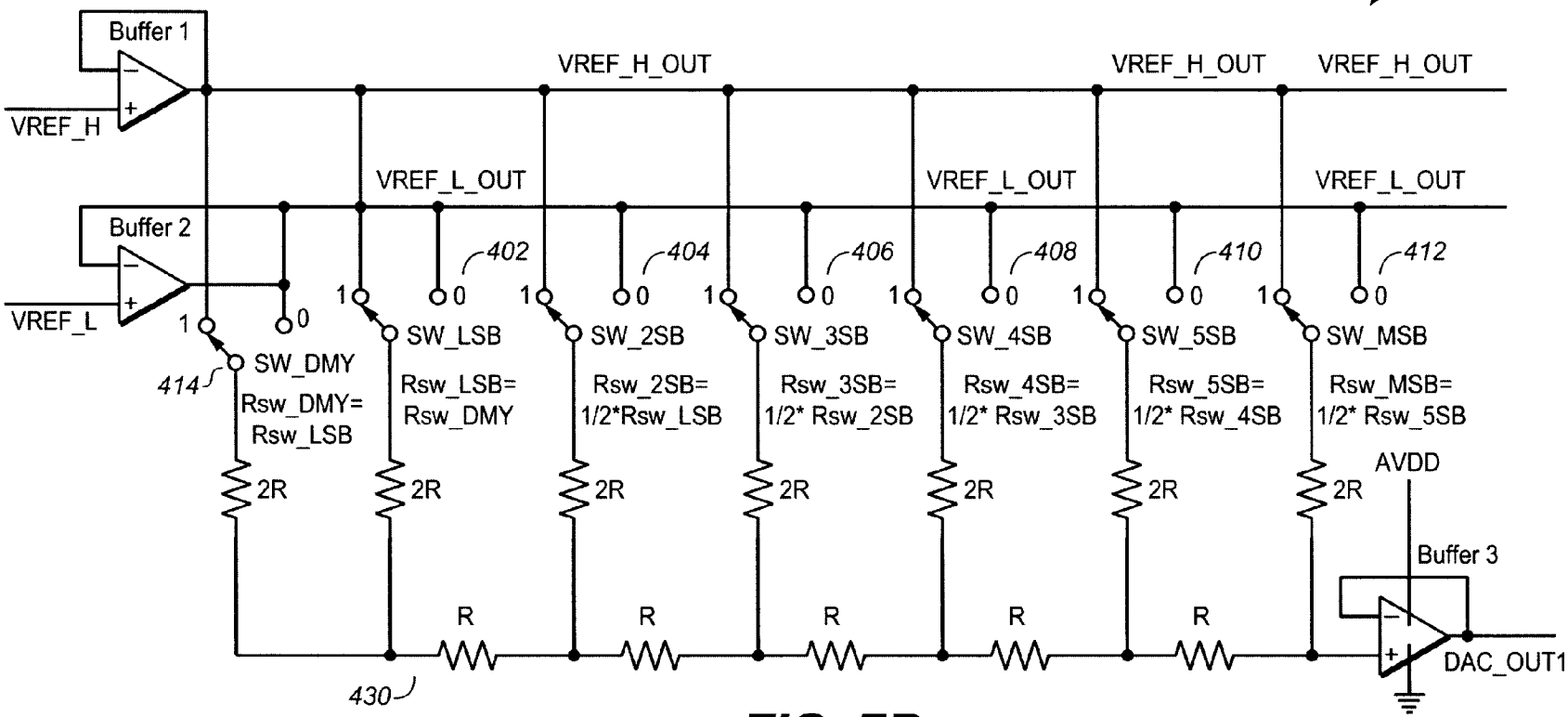

FIGS. 7A and 7B are schematic diagrams for exemplary implementations of DAC circuits with progressively increasing switch sizes, according to embodiments of the invention.

In FIG. 7A, a DAC circuit 300 with 8-bit control is depicted. DAC circuit 300 includes one switch for each bit of control (i.e., switches 302, 304, 306, 308, 310, 312, 314, and 316) and a dummy switch 318. Switches 302, 304, 306, 308, 310, 312, 314, and 316 correspond to the LSB, 2SB, 3SB, 4SB, 5SB, 6SB, 7SB, and MSB of control, respectively. Such a DAC circuit 300 can be used as an implementation for an 8-bit DAC component 26 (as shown in FIGS. 1 and 2), instead of a typically implemented 8-bit control DAC circuit 126 (as shown in FIG. 3).

In DAC circuit 300, a certain ratio is maintained for the Rdson of switches 302 through 316. In particular, the Rdson of the switch for each progressively larger control bit is a fraction (e.g., half) of the Rdson of the switch for the immediately preceding control bit. Thus, if the switch-on resistance of switch 302 for LSB is $Rdson_{LSB}$, then the switch-on resistance of switch 304 for 2SB (or $Rdson_{2SB}$) should be ½ $Rdson_{LSB}$; the switch-on resistance of switch 306 for 3SB (or $Rdson_{3SB}$) should be ½ $Rdson_{2SB}$ or ¼ $Rdson_{LSB}$; the switch-on resistance of switch 308 for 4SB (or $Rdson_{4SB}$) should be ½ $Rdson_{3SB}$ or ⅛ $Rdson_{LSB}$; and so forth. If the ratio of the Rdson of adjacent switches is maintained, then the size of switch 302 for LSB can be made much smaller compared to the switches used in a typically implemented DAC circuit 126.

To achieve the desired ratio for Rdson of the switches in DAC circuit 300, the size of the corresponding switch for each progressively larger control bit can be twice that for the immediately preceding bit. Thus, the switch corresponding to LSB will be the smallest in size, and the switch corresponding to MSB will be the largest in size. With regard to the example of FIG. 7A, switch 302 can be 1 unit, switch 304 can be 2 units, switch 306 can be 4 units, switch 308 can be 8 units, switch 310 can be 16 units, switch 312 can be 32 units, switch 314 can be 64 units, and switch 316 can be 128 units. Thus, the total layout size for switches 302 through 318 is approximately 256 units (including the dummy switch), which is considerably less than the layout size of 400 units for a typically implemented 8-bit control DAC circuit 126 such as shown and described with reference to FIG. 3.

Matching can be used to make the switches 302 through 318 the desired sizes. For example, in one embodiment, switch 302 can be implemented with a single transistor; switch 304 can be implemented with two transistors, each of which are the same size as the single transistor for switch 302; switch 306 can be implemented with four transistors, each of which are the same size as the single transistor for switch 302; and so on. As such, maintaining the ratios of the switches in DAC circuit 300 can be simpler than maintaining the absolute switch-on resistance as required for the typically-implemented DAC circuit 126.

Dummy switch 318 is provided to cancel out error terms introduced in DAC circuit 300 due to the finite switch on resistance. Dummy switch 318 can have the same size as switch 302 for the LSB control.

A resistor network 330, comprising a plurality of resistors, connects the switches 302 through 318.

FIG. 7B shows a DAC circuit 400 with 6-bit control. DAC circuit 400 includes one switch for each bit of control (i.e., switches 402, 404, 406, 408, 410, and 412) and a dummy switch 414. Switches 402, 404, 406, 408, 410, and 412 correspond to the LSB, 2SB, 3SB, 4SB, 5SB, and MSB of control, respectively. A resistor network 430, comprising a plurality of resistors, connects the switches 402 through 414. Such a DAC circuit 400 can be used as an implementation for a 6-bit control DAC circuit 234 which is part of multiplexer-based equivalent DAC component 226 (as shown in FIG. 5).

Like DAC circuit 300 shown in FIG. 7A, in DAC circuit 400 the Rdson of the switch for each progressively larger control bit is a fraction (e.g., half) of the Rdson of the switch for the immediately preceding control bit. Thus, if the switch-on resistance of switch 402 for LSB is $Rdson_{LSB}$, then the switch-on resistance of switch 404 for 2SB (or $Rdson_{2SB}$) should be ½ $Rdson_{LSB}$; the switch-on resistance of switch 406 for 3SB (or $Rdson_{3SB}$) should be ½ $Rdson_{2SB}$ or ¼ $Rdson_{LSB}$; the switch-on resistance of switch 408 for 4SB (or $Rdson_{4SB}$) should be ½ $Rdson_{3SB}$ or ⅛ $Rdson_{LSB}$; and so forth.

To achieve the desired ratio for Rdson of the switches in DAC circuit 400, the size of the corresponding switch for each progressively larger control bit can be twice that for the immediately preceding bit. Thus, for example, switch 402 can be 1 unit, switch 404 can be 2 units, switch 406 can be 4 units, switch 408 can be 8 units, switch 410 can be 16 units, and switch 412 can be 32 units. Dummy switch 414 is provided to cancel out error terms introduced in DAC circuit 400 and can be 1 unit, which is the same size as switch 402. Thus, the total layout size for switches 402 through 412 is approximately 64 units (including the dummy switch), which is significantly less than layout size of 400 units for a typically implemented 8-bit control DAC circuit 126 (shown in FIG. 3) and even less than the 8-bit DAC circuit 300 with rationing (i.e. 256 units) (shown in FIG. 7A).

In some embodiments of the present invention, the implementation for a digital-to-analog converter (DAC) with progressively increasing switch sizes (such as shown in FIGS. 7A and 7B) is used in conjunction with the multiplexer-based equivalent DAC component (such as shown in FIG. 5). When this is done, there is a substantial savings in overall layout size of a digital programmable gamma correction circuit as the implementation for each DAC component is much condensed, thus providing significant layout and cost advantages.

It should be noted the implementation for a digital-to-analog converter (DAC) with progressively increasing switch sizes (shown and described with reference to FIGS. 7A and 7B) and the multiplexer-based equivalent for a DAC (shown and described with reference to FIGS. 5 and 6) can be used independently. Thus, for example, an 8-bit control DAC with progressively increasing switch sizes can be used in a digital programmable gamma correction circuit which does not have any multiplexers. Similarly, the multiplexer-based equivalent DAC can be implemented without progressively increasing switch sizes. In either case, embodiments of the present invention provide advantages.

Although the present invention and its advantages have been described in detail, it should be understood that various changes, substitutions, and alterations can be made therein without departing from the spirit and scope of the invention as defined by the appended claims. That is, the discussion included in this application is intended to serve as a basic description. It should be understood that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Neither the description nor the terminology is intended to limit the scope of the claims.

What is claimed is:

1. A system for providing gamma correction in a thin-film-transistor (TFT) liquid-crystal-display (LCD), the system comprising:

a resistor network comprising a plurality of resistors coupled in series between a first terminal and a second terminal, the resistor network operable to provide a plurality of voltage values;

a plurality of multiplexers coupled to the resistor network, each multiplexer operable to receive and multiplex the plurality of voltage values from the resistor network to provide a first rail voltage and a second rail voltage; and a digital-to-analog converter coupled to the plurality of multiplexers and operable to receive digital control data, the digital-to-analog converter operable to provide an output voltage for gamma correction in response to the digital control data, wherein the output voltage has a value between the first rail voltage and the second rail voltage.

2. The system of claim 1 comprising:

a first buffer circuit for buffering the first rail voltage; and a second buffer circuit for buffering the second rail voltage.

3. The system of claim 1 wherein n bits of digital control data are provided to the system, and wherein each of the plurality of multiplexers receives x of the n bits of digital control data and the digital-to-analog converter receives n-x of the n bits of digital control data.

4. The system of claim 3 wherein n equal one of 8, 9, and 10 and x equal one of 2, 3, and 4.

5. The system of claim 1 wherein each of the plurality of multiplexers comprises a plurality of transmission gates, each transmission gate operable to transmit a respective one of the voltage values out of the multiplexer.

6. The system of claim 1 wherein the digital-to-analog converter comprises a plurality of switches, each switch controlled by a respective bit of digital control data.

7. The system of claim 6 wherein the switches have different sizes.

8. The system of claim 7 wherein the size of each switch is proportional to the significance of its respective bit of digital control data.

9. The system of claim 6 wherein the digital-to-analog converter comprises a dummy switch.

10. The system of claim 6 comprising a resistor network coupled to the plurality of switches.

11. The system of claim 1 wherein the first terminal is operable to receive a first reference voltage and the second terminal is operable to receive a second reference voltage.

12. A multiplexer-based circuit equivalent to an digital-to-analog converter with n bits of digital control, the circuit comprising:

a first and second multiplexers operable to receive x of the n bits of digital control, the first and second multiplexers operable to multiplex a plurality of voltage values in response to the x bits of digital control to provide a first rail voltage and a second rail voltage, respectively; and a digital-to-analog converter coupled to the first and second multiplexers and operable to receive n-x of the n bits of digital control, the digital-to-analog converter operable to provide an output voltage for gamma correction in response to the n-x bits of digital control data, wherein the output voltage has a value between the first rail voltage and the second rail voltage.

13. The circuit of claim 12 wherein n equal one of 8, 9, 10 and 12 and x equal one of 2, 3, 4, 5 and 6.

14. The circuit of claim 12 comprising a resistor network coupled to the first and second multiplexers, the resistor network operable to provide the plurality of voltage values.

15. The circuit of claim 12 wherein the resistor network comprises a plurality of resistors coupled in series between a first terminal and a second terminal.

16. The circuit of claim 15 wherein the first terminal is operable to receive a first reference voltage and the second terminal is operable to receive a second reference voltage.

17. The circuit of claim 12 comprising:

a first buffer circuit operable to buffer the first rail voltage; and a second buffer circuit operable to buffer the second rail voltage.

18. The circuit of claim 12 wherein each of the first and second multiplexers comprises a plurality of transmission gates, each transmission gate operable to transmit a respective one of the plurality of voltage values out of the first or second multiplexer.

19. The circuit of claim 12 the digital-to-analog converter comprises n-x switches, each switch controlled by a respective one of the n-x bits of digital control.

20. The circuit of claim 19 wherein the n-x switches have different sizes.

21. The circuit of claim 20 wherein the size of each of the n-x switches is proportional to the significance of its respective bit of digital control.

22. The circuit of claim 12 wherein the digital-to-analog converter comprises a dummy switch.

23. A digital-to-analog converter with n bits of digital control for providing gamma correction in a thin-film-transistor (TFT) liquid-crystal-display (LCD) comprising n number of switches, each of the n switches being controlled by a respective bit of digital control, wherein a first of the n switches is one size and each of the remaining n switches is an increasingly larger size relative to the first of the n switches.

24. The digital-to-analog converter of claim 23 comprising a resistor network coupled to the n switches.

25. The digital-to-analog converter of claim 23 wherein the n switches are matched.

26. The digital-to-analog converter of claim 23 wherein each of the n switches are implemented with at least one transistor.

27. The digital-to-analog converter of claim 23 comprising a dummy switch.

28. The digital-to-analog converter of claim 27 wherein the dummy switch is the same size as the first of the n switches.

29. A digital-to-analog converter with n bits of digital control for providing gamma correction in a thin-film-transistor (TFT) liquid-crystal-display (LCD) comprising:

a dummy switch having a size; and n number of additional switches, each of the n additional switches being controlled by a respective bit of digital control, wherein a first of the n additional switches is the same size as the dummy switch and each of the remaining n additional switches is an increasingly larger size relative to the dummy switch.

30. The digital-to-analog converter of claim 29 comprising a resistor network coupled to the dummy switch and the n additional switches.

31. The digital-to-analog converter of claim 29 wherein the dummy switch and the n additional switches are matched.

32. The digital-to-analog converter of claim 29 wherein each of the dummy switch and the n additional switches are implemented with at least one transistor.

33. A system with n bits of digital control for providing gamma correction in a thin-film-transistor (TFT) liquid-crystal-display (LCD), the system comprising:

a plurality of multiplexers operable to receive x of the n bits of digital control, the plurality of multiplexers operable to multiplex a plurality of voltage values in response to the x bits of digital control to provide a first rail voltage and a second rail voltage; and a digital-to-analog converter coupled to the plurality of multiplexers and operable to receive n-x of the n bits of digital control, the digital-to-analog converter operable to provide an output voltage for gamma correction in response to the n-x bits of digital control data, wherein the output voltage has a value between the first rail voltage and the second rail voltage;

wherein the digital-to-analog converter comprises n-x number of switches, each of the n-x switches being controlled by a respective bit of digital control, wherein a first of the n-x switches is one size and each of the remaining n-x switches is an increasingly larger size relative to the first of the n-x switches.

34. The system of claim 33 wherein n equal one of 8, 9, 10 and 12 and x equal one of 2, 3, 4, 5 and 6.

35. The system of claim 33 comprising a resistor network coupled to the plurality of multiplexers, the resistor network operable to provide the plurality of voltage values.

36. The system of claim 35 wherein the resistor network comprises a plurality of resistors coupled in series between a first terminal and a second terminal.

37. The system of claim 36 wherein the first terminal is operable to receive a first reference voltage and the second terminal is operable to receive a second reference voltage.

38. The system of claim 33 comprising:

a first buffer circuit operable to buffer the first rail voltage; and a second buffer circuit operable to buffer the second rail voltage.

39. The system of claim 33 wherein each of the plurality of multiplexers comprises a plurality of transmission gates, each transmission gate operable to transmit a respective one of the plurality of voltage values out of the multiplexer.

40. The system of claim 33 wherein the size of each of the n-x switches is proportional to the significance of its respective bit of digital control.

41. The system of claim 33 wherein the digital-to-analog converter comprises a dummy switch.

* * * * *